US008047795B2

(12) United States Patent
Pearce

(10) Patent No.: US 8,047,795 B2
(45) **Date of Patent: *Nov. 1, 2011**

(54) FAN BLADE MOUNTING SYSTEM

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 1083 days.

This patent is subject to a terminal disclaimer.

(21) Appl. No.: 11/854,756

(22) Filed: Sep. 13, 2007

(65) Prior Publication Data

US 2008/0175713 A1 Jul. 24, 2008

Related U.S. Application Data

(63) Continuation-in-part of application No. 11/829,151, filed on Jul. 27, 2007, now Pat. No. 7,914,260, which is a continuation-in-part of application No. 11/655,393, filed on Jan. 18, 2007, now Pat. No. 7,665,970.

(51) Int. Cl.
*F04D 29/34* (2006.01)

(52) U.S. Cl. ..... 416/210 R; 416/231 B

(58) Field of Classification Search ..... 416/210 R, 416/231 B

See application file for complete search history.

(56) References Cited

U.S. PATENT DOCUMENTS

| | | | | |
|---|---|---|---|---|
| 3,551,070 | A | 12/1970 | Glucksman | |
| 4,511,310 | A | 4/1985 | Pearce | |
| 4,634,345 | A | 1/1987 | Stanek et al. | |
| 4,936,751 | A * | 6/1990 | Marshall | 416/246 |
| D312,688 | S | 12/1990 | Mason | |
| D323,384 | S | 1/1992 | Mason | |
| D324,100 | S | 2/1992 | Holbrook | |
| D325,776 | S | 4/1992 | Scofield et al. | |
| D328,947 | S | 8/1992 | Holbrook | |
| 5,222,864 | A | 6/1993 | Pearce | |
| 5,297,936 | A | 3/1994 | Sato | |
| D346,209 | S | 4/1994 | Holbrook | |
| 5,304,037 | A | 4/1994 | Scofield | |
| D349,336 | S | 8/1994 | Tsuji | |
| D354,804 | S | 1/1995 | Tsuji | |
| D357,978 | S | 5/1995 | Young | |
| D358,877 | S | 5/1995 | Tsuji | |
| D361,377 | S | 8/1995 | Tsuji | |
| 5,462,412 | A | 10/1995 | Scofield et al. | |
| D367,321 | S | 2/1996 | Holbrook | |
| 5,501,010 | A | 3/1996 | Scott | |
| 5,593,283 | A | 1/1997 | Scott | |
| 5,944,486 | A * | 8/1999 | Hodgkins, Jr. | 416/210 R |
| 5,944,487 | A | 8/1999 | Pearce | |
| 5,954,449 | A * | 9/1999 | Wu | 403/315 |

(Continued)

*Primary Examiner* — Ninh H Nguyen

(74) *Attorney, Agent, or Firm* — Baker Donelson; Dorian B. Kennedy

(57) ABSTRACT

A ceiling fan is disclosed having an electric motor (81) with a bottom plate (80) having two internally threaded screw mounting holes (82) associated with each blade iron (83). Each blade iron has two, elongated, arcuate mounting holes (84) therethrough which are alignable with motor bottom plate mounting holes (82). A mounting screw (85) passes through the blade iron mounting hole (84) and is threaded into the motor mounting hole (82). Screws (85) allow limited pivotal movement of the blade irons (83) relative to the motor bottom plate. Each blade iron is coupled to a blade (86) by three mounting screws (87). Each blade includes a first round mounting hole (88) adjacent the motor and two, elongated, arcuate mounting holes (89) distal the motor. Again, the screws allow for limited pivotal movement between the blade and its associated blade iron.

20 Claims, 7 Drawing Sheets

U.S. PATENT DOCUMENTS

| | | | | |
|---|---|---|---|---|
| 6,039,540 | A * | 3/2000 | Wu | 416/210 R |
| 6,364,612 | B1 | 4/2002 | Tseng | |
| 6,382,917 | B1 | 5/2002 | Zuege | |
| 6,644,925 | B1 * | 11/2003 | Collmar | 416/210 R |
| 6,857,854 | B2 | 2/2005 | Pearce | |
| 6,863,499 | B2 | 3/2005 | Pearce | |
| 6,902,375 | B2 | 6/2005 | Bird et al. | |
| 6,932,576 | B2 | 8/2005 | Bird | |
| 7,665,970 | B2 * | 2/2010 | Pearce | 416/205 |
| 7,914,260 | B2 * | 3/2011 | Pearce | 416/205 |
| 2005/0123403 | A1 * | 6/2005 | Tai | 416/210 R |
| 2006/0147310 | A1 | 7/2006 | Steiner | |
| 2007/0128040 | A1 | 6/2007 | Udall | |

* cited by examiner

FAN BLADE MOUNTING SYSTEM

REFERENCE TO RELATED APPLICATION

This is a continuation-in-part of U.S. patent application Ser. No. 11/829,151 filed Jul. 27, 2007 now U.S. Pat. No. 7,914,260, which is a continuation-in-part of U.S. patent application Ser. No. 11/655,393 filed Jan. 18, 2007 now U.S. Pat. No. 7,665,970.

TECHNICAL FIELD

This invention relates to a fan system for mounting blade irons and blades, and specifically to systems for automatically balancing the blade irons and blades of a fan.

BACKGROUND OF THE INVENTION

Many different types of fans exist today, such as ceiling fans, table fans, pedestal fans, and fans used in conjunction with mechanical equipment. Most of these fans include a blade and a blade mount or blade iron which couples the blade to the motor.

Electrically powered ceiling fans typically have a motor mounted within a stationary housing that is suspended from a ceiling. In operation, the motor rotates an annular array of individual extensions in the form of blade mounts or blade irons. Each blade iron is associated with a blade mounted thereto.

The blades of ceiling fans are usually coupled to the blade irons by passing mounting screws through holes in the blade and into threaded holes in the blade iron. The blade irons are then mounted to the motor.

Fan blade imbalance and the associated ceiling fan wobble may result from a variety of off-balanced or imbalanced discrepancies associated with the ceiling fan blades, including variations in blade pitch angle, dihedral angle, uneven circumferential spacing between adjacent blade pairs, blade warpage and uneven radial spacing of the blades from the vertical axis of rotation. Ceiling fan wobble, and the associated vibration, creates undesirable noise, is visually distracting, and may adversely affect the service life of the ceiling fan.

Accordingly, it is seen that a need remains for a ceiling fan system that can be quickly and easily balance the rotating blades. It is to the provision of such therefore that the present invention is primarily directed.

SUMMARY OF THE INVENTION

In a preferred form of the invention a fan comprises an electric motor, an annular array of blade irons wherein each blade iron is coupled to the motor for lateral pivotal movement between the motor and the blade iron, and a ceiling fan blade associated with each blade iron of the annular array of blade irons. With this construction, a blade iron may be pivotally moved relative to the motor towards an equilibrium position.

In another preferred form of the invention a fan comprises an electric motor, an annular array of blade irons, and a ceiling fan blade associated with each blade iron of the annular array of blade irons. Each blade is coupled to the blade iron for lateral pivotal movement between the blade and the blade iron. With this construction, a blade may be pivotally moved relative to the blade iron towards an equilibrium position.

DETAILED DESCRIPTION

Figure 1:
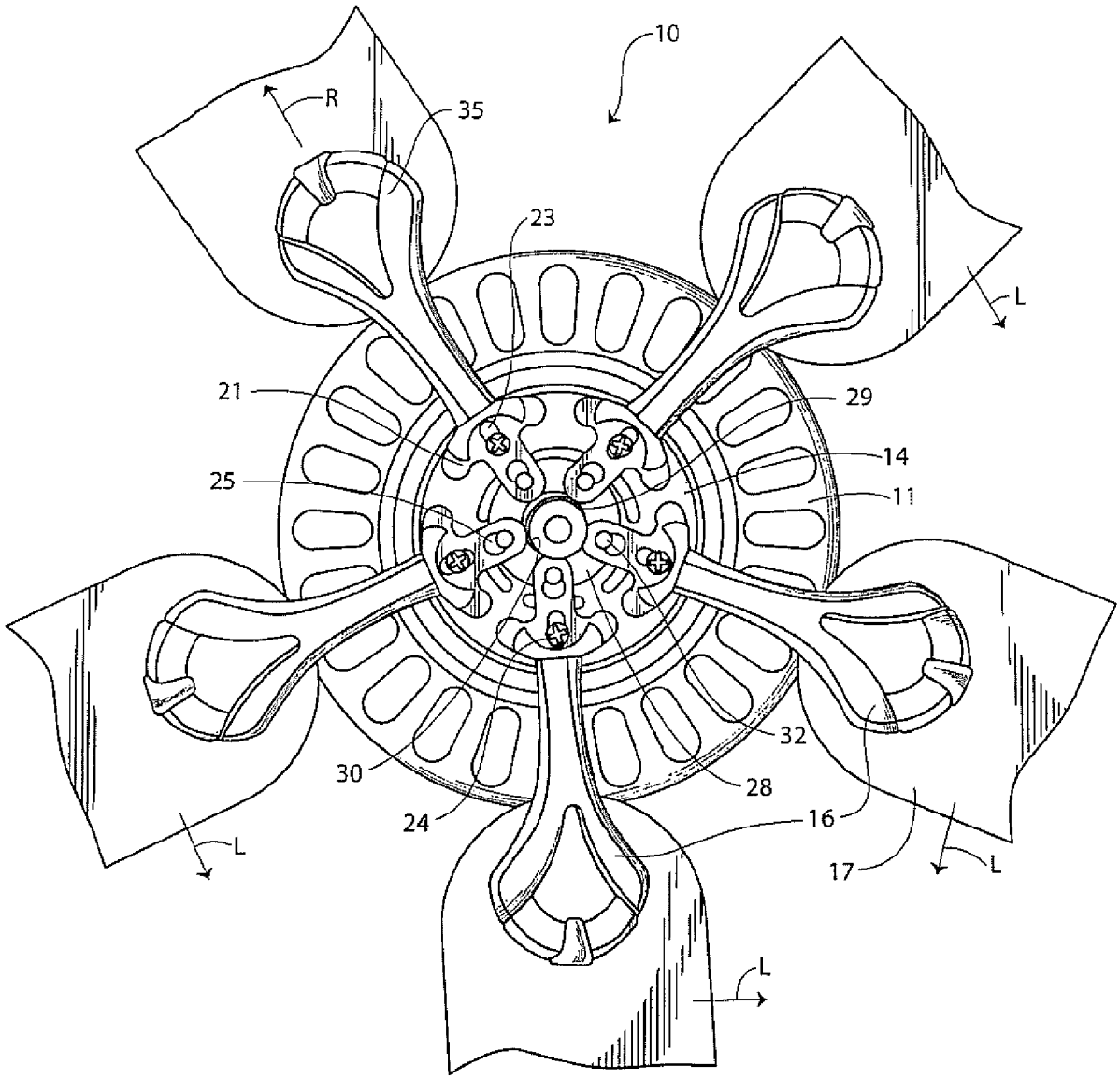
FIG. 1 is a bottom view of a ceiling fan embodying principles of the invention in a preferred form.
Figure 2:
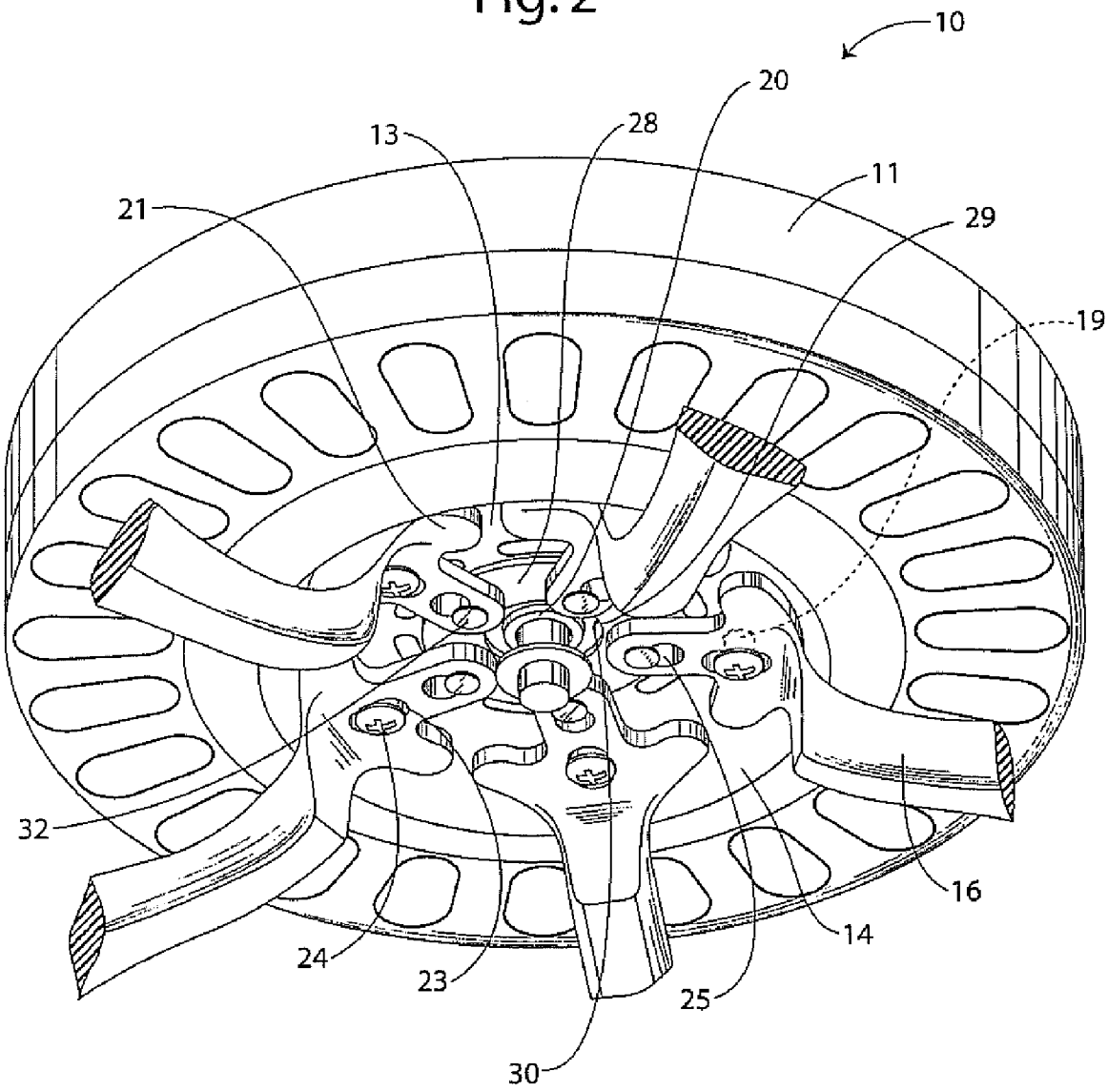
FIG. 2 is a perspective view of a portion of the ceiling fan of FIG. 1.

With reference next to the drawings, there is shown a ceiling fan 10 having a motor housing 11 which encases an electric motor 13 connected to a source of electric power by unshown wires. The motor 13 includes a bottom mounting plate 14 that rotates and thereby drives an annular array of blade irons 16, each having a blade 17 mounted thereto in conventional fashion. The motor bottom mounting plate 14 has an annular array of threaded mounting holes 19 and a centrally positioned, raised, annular stop 20.

Each blade iron 16 has a motor mounting flange 21 configured to be coupled with the bottom mounting plate 14 of the electric motor 13. The mounting flange 21 has an elongated slot 23 therethrough which is aligned with the threaded mounting hole 19 of the bottom mounting plate 14. A retaining member in the form of a mounting bolt or screw 24 extends through the elongated slot 23 and is threadably received in the mounting hole 19. The mounting screw 24 however allows radial and pivotal movement of the blade iron 16 relative to the bottom mounting plate 14 of the motor. The motor mounting flange 21 also includes a keyhole shaped hole 25.

The ceiling fan 10 also includes an annular balancing member in the form of a balancing ring 28 positioned concentrically about the annular stop 20. The concentric positioning of the balancing ring allows for limited movement relative to the bottom mounting plate 14. The central hole 29 within the balancing ring is defined by inner walls 30 which contacts the annular stop 20 to limit the radial movement of the balancing ring 28. The balancing ring 28 includes an annular array of rivets 32 which are received within the keyhole shaped hole 25 of the blade irons 16.

Figure 3:
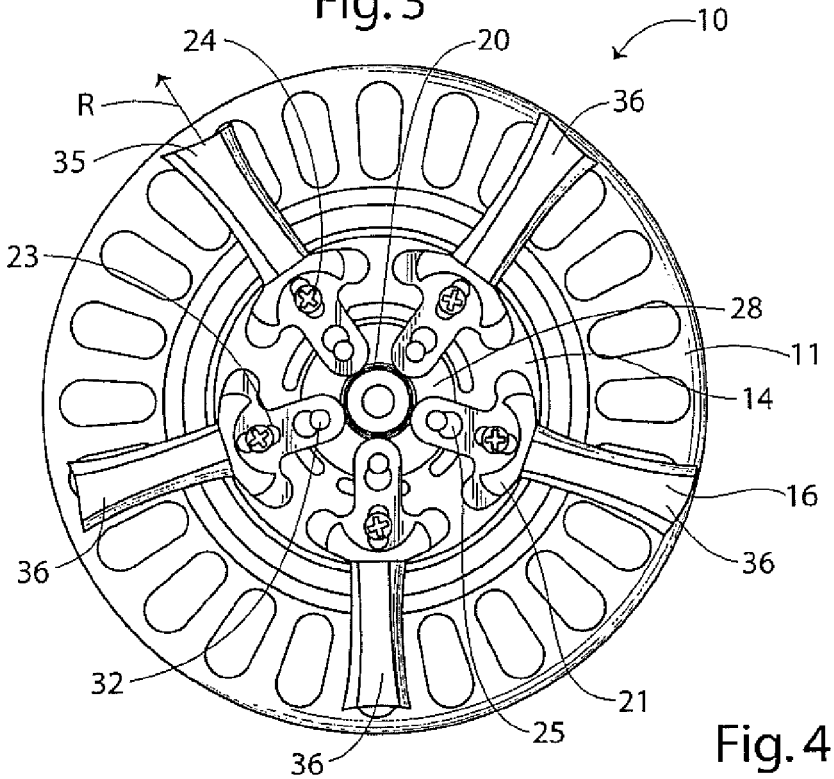
FIG. 3 is a bottom view of a ceiling fan of FIG. 1.

In use, the balancing ring 28 initially is centrally positioned so that the blade irons are equally spaced from the center point of the bottom mounting plate 14, as shown in FIG. 3. The operation of the motor 13 rotates the motor bottom mounting plate 14, thereby rotating the blade irons 16 and blades 17, creating a centrifugal force upon each blade iron. Should a heavier combined blade iron and blade 35 cause an imbalance due to it having a weight greater (resulting in a greater centrifugal force) than the other combinations of blade irons and blades 36, the ceiling fan automatically balances itself in a manner described in more detail hereinafter. Of course, other factors previously recited may also cause an off-balancing of a combined blade iron and blade, for ease of description described hereinafter as simply the blade iron.

Figure 4:
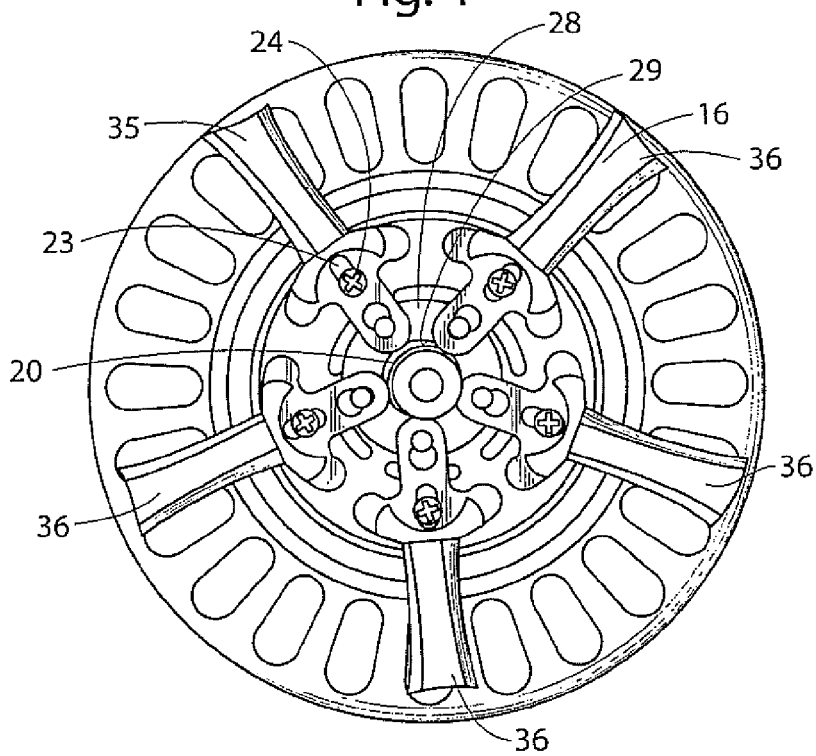
FIG. 4 is a bottom view of a ceiling fan of FIG. 1.
Figure 5:
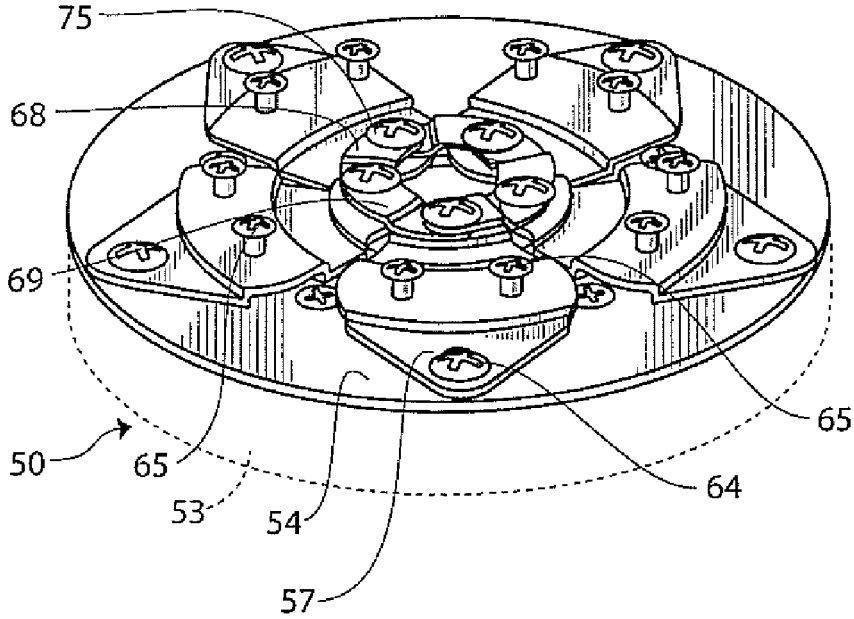
FIG. 5 is a bottom, perspective view of a portion of a ceiling fan embodying principles of the invention in another preferred form.
Figure 6:
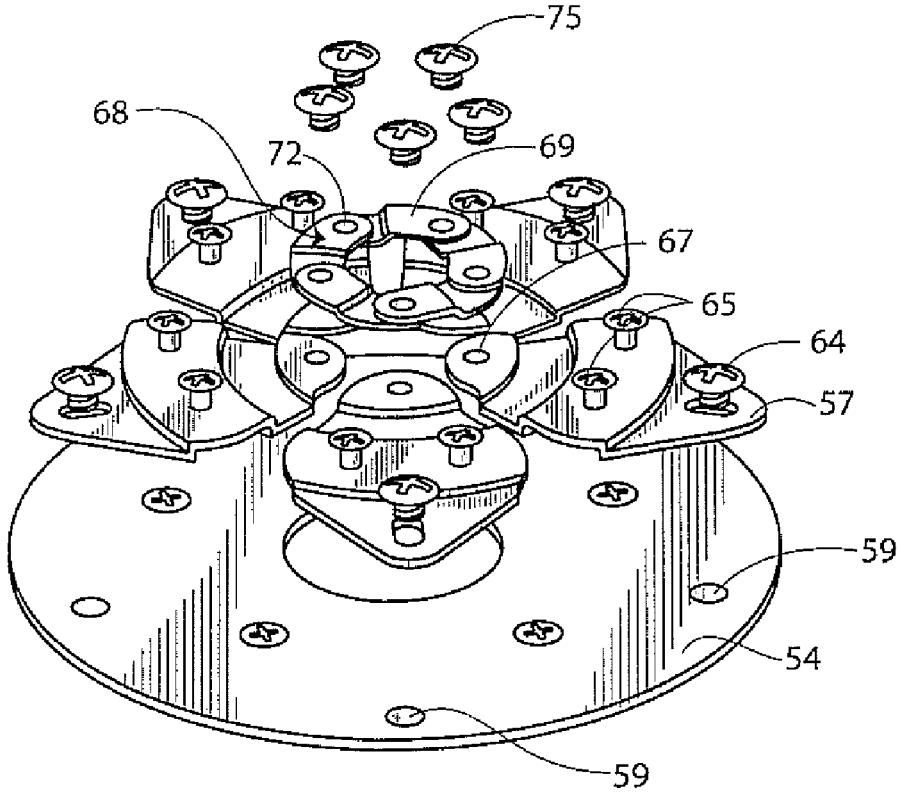
FIG. 6 is an exploded view of the portion of the ceiling fan of FIG. 5.
Figure 7:
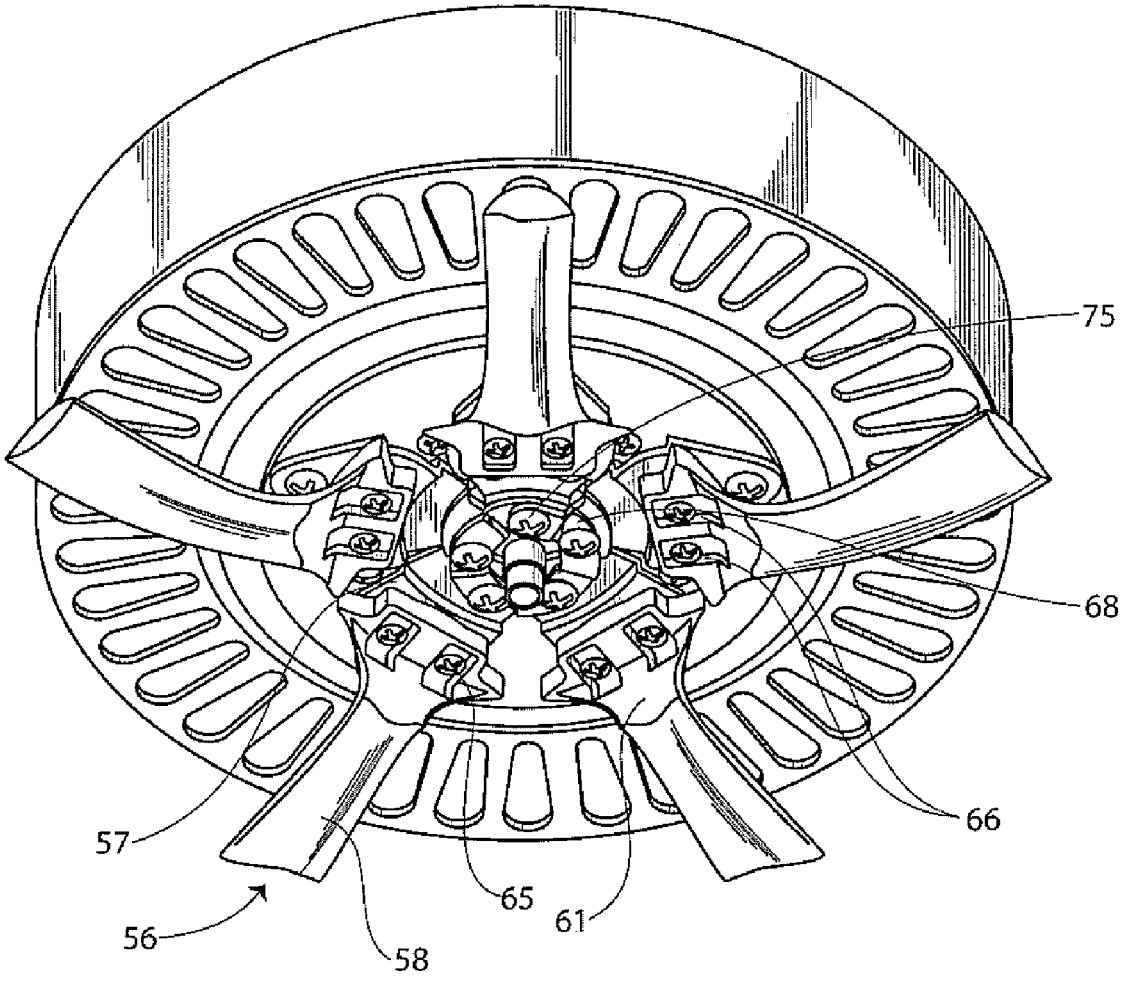
FIG. 7 is a bottom, perspective view of a portion of the ceiling fan of FIG. 5, shown with portions of the blade iron arms.
Figure 8:
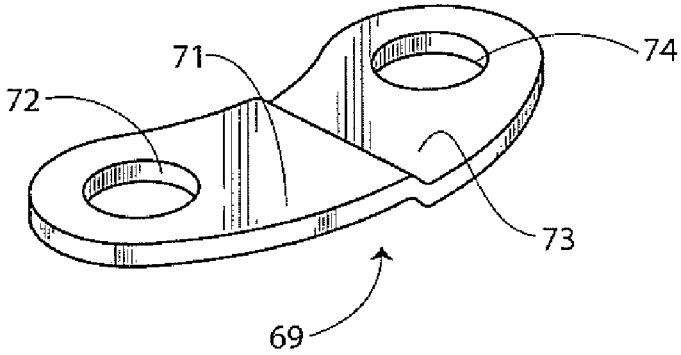
FIG. 8 is a perspective view of a link of a ring of the ceiling fan of FIG. 5.

As shown in FIG. 4, the ceiling fan corrects this off-balancing by establishing an equilibrium balance through the subsequent relative movements of the blade irons. Here, the heavier blade iron 35 moves in an outboard direction from the center of the bottom mounting plate 14 because of its relative weight. The outboard movement of the heavier blade iron 35 is illustrated by arrow H. The outboard movement of the heavier blade iron 35 forces the balancing ring 28 coupled therewith to move outboard in relatively the same direction, as illustrated by arrow R.

The outboard movement of the balancing ring 28 in direction H causes the other blade irons 36 to pivot and/or longitudinally move in an "opposite" direction to the movement of the heavier blade iron 35, as indicated by arrows L. The term opposite is intended to denote a direction generally away from the direction of the heavier blade iron 35 even though such movement is not 180 degrees in the opposite direction. For example, the movement of the two oppositely disposed blade irons 36 is indicated by arrows L, which is shown to be approximately 120 degrees from the direction of arrow H. The term opposite direction may mean a direction as little as 91 degrees offset from direction H.

The pivotal movement of the other blade irons 36 is caused by the pulling action on the blade irons 36 by rivets 32 as the balancing ring 28 moves in direction R and the blade irons are forced to pivot about mounting screws 24. Similarly, the longitudinal movement of the other blade irons 36 is provided through the pulling action on the blade irons by rivets 32 thereby causing the blade irons to move relative to mounting screws 24 along the elongated slots 23. As such, each mounting screw 24 and slot 23 establishes a first pivot about which the blade iron pivotally and radially moves relative to the motor, while the rivet 32 and keyhole shaped hole 25 establish a second pivot about which the blade iron pivotally moves relative to the balancing ring 28.

The movement of the other blade irons 36 in a direction opposite to the direction of the heaviest blade iron counterbalance the outboard movement of the heavier blade iron 35, thereby establishing an equilibrium balance upon the entire system. This equilibrium balance of the rotating blade irons/blades restricts the wobbling motion of the ceiling fan due to an off balanced blade iron and/or blade.

It should be understood that the rivets 32 may also be in the form of posts, screws, bolts, or other movement limiting means.

It should be understood that the stop 20 may be in the other forms such as seats, walls, flanges, posts, screws within oversized holes, or other obstructions. These stops may also be positioned within or outside of the balancing member, so long as they allow but limit radial movement of the balancing member.

It should be understood that the system will work equally for more than one blade iron and blade combination being off-balanced, as the entire system will move to an equilibrium position.

With reference next to FIGS. 5 through 8 of the drawings, there is shown a ceiling fan 50 having an electric motor 53 connected to a source of electric power by unshown wires. The motor 53 includes a bottom mounting plate 54 that rotates and thereby drives an annular array of blade irons 56, each having a blade mounted thereto in conventional fashion. Here, the blade iron 56 includes two separate pieces, a blade iron mounting bracket 57 and a conventionally styled blade iron arm 58. The motor bottom mounting plate 54 has an annular array of threaded mounting holes 59.

Each blade iron arm 58 has a motor mounting flange 61 configured to be coupled with the blade iron mounting bracket 57. The mounting iron mounting bracket 57 has an elongated slot 63 therethrough which is aligned with the threaded mounting hole 59 of the bottom mounting plate 54. A retaining member in the form of a mounting bolt or screw 64 extends through the elongated slot 63 and is threadably received in the mounting hole 59. The mounting screw 64 however allows radial and pivotal movement of the blade iron mounting bracket 57, and thereby the entire blade iron 56, relative to the bottom mounting plate 54 of the motor. The blade iron arm 58 is coupled to the blade iron mounting bracket 57 through two mounting screws 65 passing through mounting holes 66 extending through the motor mounting flange 61. Each blade iron mounting bracket 57 also has an inboard threaded mounting hole 67 therein opposite elongated slot 63.

The ceiling fan 50 also includes an annular balancing member in the form of a segmented balancing ring 68. The balancing ring 68 is comprised of a series of articulating, arcuate, stepped links 69, best shown in FIG. 8, i.e. the ring 68 has multiple joints to allow articulated and flexible movement of the links 69 and thereby the entire ring. The number of stepped links 69 preferably equals the number of blade irons. Each link 69 has an upper portion 71 with a hole 72 therethrough and a lower portion 73 with a hole 74 therethrough. A ring mounting screw 75 passes through the upper portion hole 72, through an adjacent link's lower portion hole 74 and into the threaded mounting hole 67 of the blade iron mounting bracket 57. The concentric positioning of the balancing ring 68 allows for limited movement relative to the bottom mounting plate 54

In use, the balancing ring 68 initially is centrally positioned so that the blade irons are equally spaced from the center point of the bottom mounting plate 54, similarly to that previously described in the first embodiment. The operation of the motor 53 rotates the motor bottom mounting plate 54, thereby rotating the blade irons 56 and blades 57, creating a centrifugal force upon each blade iron. Should a heavier combined blade iron and blade cause an imbalance due to it having a weight greater (resulting in a greater centrifugal force) than the other combinations of blade irons and blades, the ceiling fan automatically balances itself in a manner described in more detail hereinafter. Of course, other factors previously recited may also cause an off-balancing of a combined blade iron and blade, for ease of description described hereinafter as simply the blade iron.

The ceiling fan corrects this off-balancing by establishing an equilibrium balance through the subsequent relative movements of the blade irons. As previously described, a heavier blade iron moves in an outboard direction from the center of the bottom mounting plate 54 because of its relative weight. The outboard movement of the heavier blade iron, through the movement of the blade iron mounting bracket 57, forces the balancing ring 68 coupled therewith to move outboard in relatively the same direction. The segmenting of the balancing ring also allows the ring to elongate in the direction of the heavier blade iron, thereby pulling the adjacent blade iron mounting brackets 57 on either side of the heavier blade iron greater than the remaining two blade iron mounting brackets distal the heavier blade. It is believed that this elongation of the ring provides a greater balancing effect on the blade irons and blade than compared to the solid ring of FIGS. 1-4.

The outboard movement of the balancing ring 68 causes the other blade irons to pivot and/or longitudinally move in an "opposite" direction to the movement of the heavier blade iron. The term opposite is intended to denote a direction generally away from the direction of the heavier blade iron even though such movement is not 180 degrees in the opposite direction.

The pivotal movement of the other blade irons is caused by the pulling action on the blade iron mounting brackets by mounting screws 75 as the balancing ring 68 moves and the blade iron mounting brackets 57 are forced to pivot about mounting screws 64. Similarly, the longitudinal movement of the other blade irons is provided through the pulling action on the blade iron mounting brackets by mounting screws 75 thereby causing the blade iron mounting brackets to move relative to mounting screws 64 along the elongated slots 63. As such, each mounting screw 64 and slot 63 establishes a first pivot about which the blade iron pivotally and radially moves relative to the motor, while the mounting screw 75 and mounting hole 67 establish a second pivot about which the blade iron pivotally moves relative to the balancing ring 68.

The movement of the other blade irons in a direction opposite to the direction of the heaviest blade iron counterbalance the outboard movement of the heavier blade iron, thereby establishing an equilibrium balance upon the entire system. This equilibrium balance of the rotating blade irons/blades restricts the wobbling motion of the ceiling fan due to an off balanced blade iron and/or blade.

It should be understood that the system will work equally for more than one blade iron and blade combination being off-balanced, as the entire system will move to an equilibrium position. Also, the blade iron may be of unitary construction with the mounting brackets 57 formed with or fixedly mounted with the arms 58.

Figure 9:
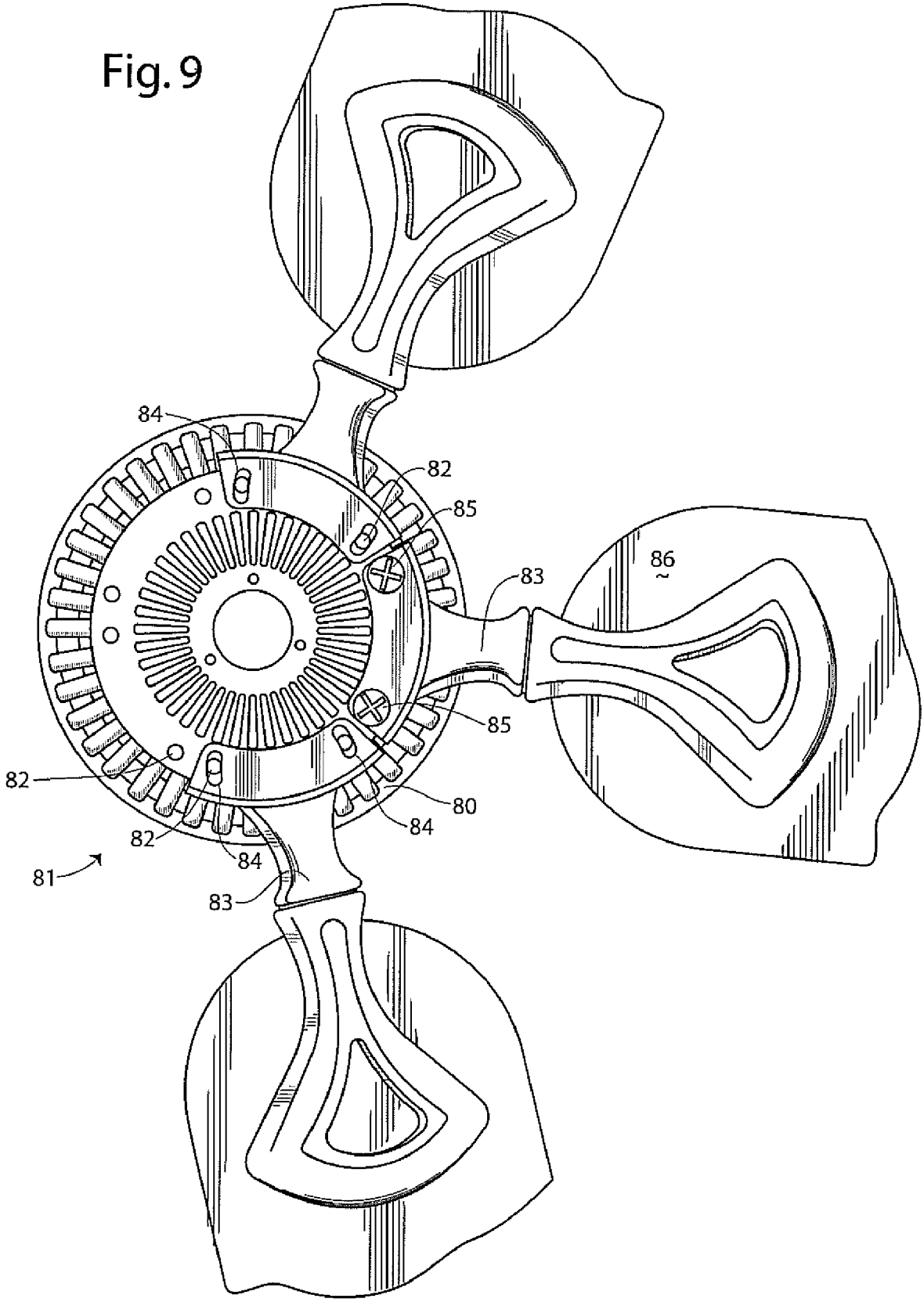
FIG. 9 is a bottom view of a portion of a ceiling fan embodying principles of the invention in another preferred form.
Figure 10:
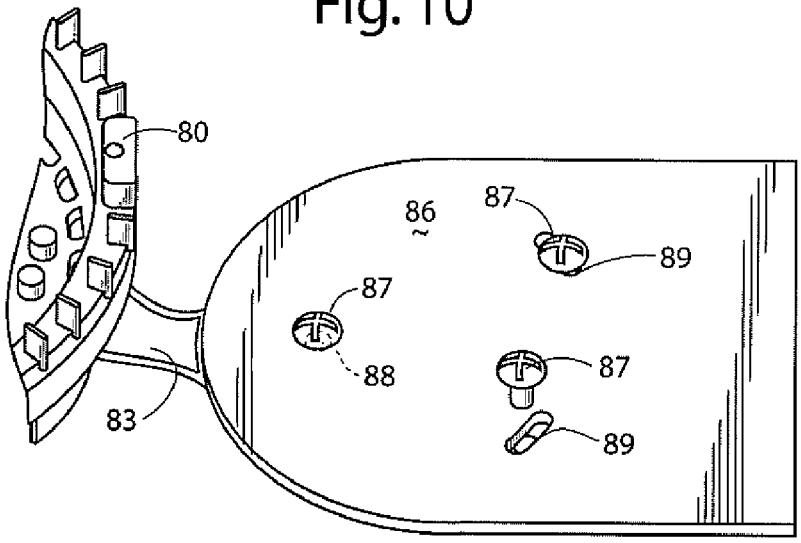
FIG. 10 is a top view of a portion of a ceiling fan embodying principles of the invention in another preferred form.
Figure 11:
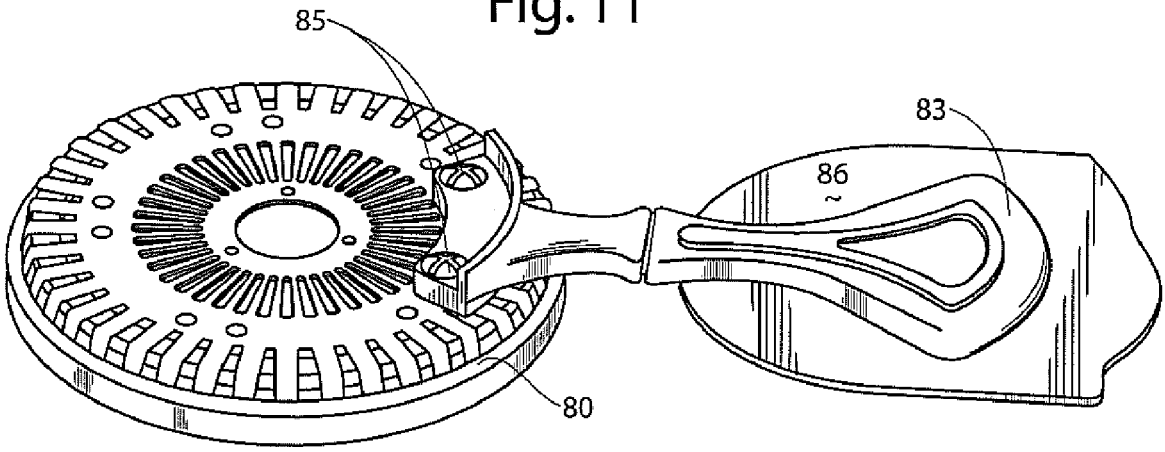
FIG. 11 is a bottom view of the portion of the ceiling fan of FIG. 10.

With reference next to FIGS. 9 through 11, there is shown portions of a ceiling fan embodying principles of the invention in another form. There is shown the bottom portion or plate 80 of an electric motor 81. The bottom plate 80 has two internally threaded screw mounting holes 82 associated with each of five blade irons 83, although only three blade irons 83 are shown for clarity. The number of blades and blade irons is generally irrelevant to the present invention.

Each blade iron 83 has two, elongated, arcuate mounting holes 84 therethrough which are alignable with motor bottom plate mounting holes 82. A mounting screw 85 passes through each blade iron mounting hole 84 and is threaded into the motor mounting hole 82. The screws 85 and length of the elongated mounting holes 84 allow limited pivotal movement of the blade irons 83 relative to the motor bottom plate 80, as such unshown additional bushings may be provided to aid relative movement therebetween.

Each blade iron 83 is coupled to a blade 86 by three mounting screws 87. The blade 86 includes a first round mounting hole 88 adjacent the motor and two, elongated, arcuate mounting holes 89 distal the motor. Again, the screws 87 and length of the elongated mounting holes 89 allow for limited pivotal movement between the blade 86 and its associated blade iron 83. As such, unshown additional bushings may be included to aid the relative movement between the blade and blade iron.

In use, the misalignment of a blade is compensated by the pivotal movement of that blade and/or one or more other blades during rotation of the ceiling fan. The compensating pivotal movement may occur between the blade iron 83 and motor 81 through relative movement of mounting screws 85 along elongated mounting holes 84, and/or through pivotal movement between the blade 86 and blade iron 83 through relative movement of mounting screws 87 along elongated mounting holes 89, i.e., the blade iron may pivot and/or the blade may pivot. The pivotal movement of the blade iron and/or blade re-balances the ceiling fan.

Figure 12:
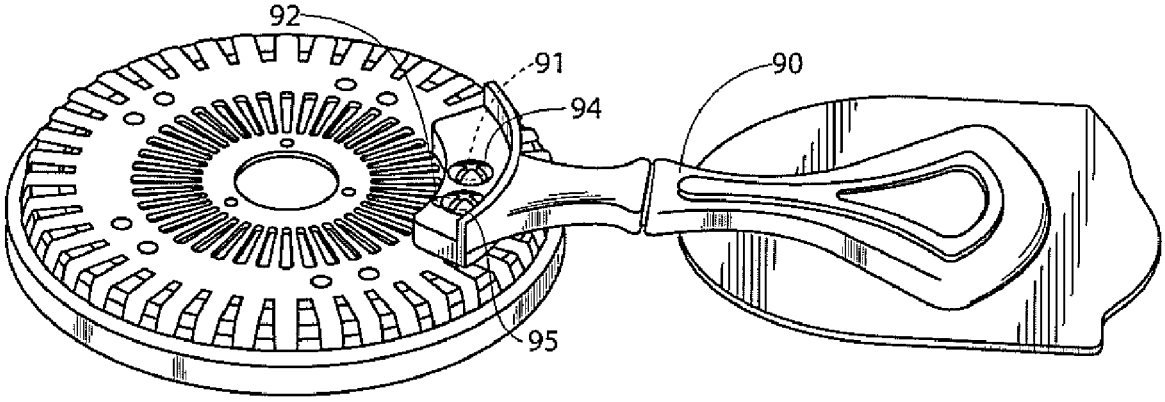
FIG. 12 is a bottom view of a portion of a ceiling fan embodying principles of the invention in yet another preferred form.

With reference next to FIG. 12, there is shown a portion of a ceiling fan in another preferred form of the invention. Here, the construction is essentially the same as previously described in reference to FIGS. 9 and 10 except for the pattern of the mounting holes. In this embodiment, the blade iron 90 has a round, centrally or radially aligned mounting hole 91 and an arcuate, second mounting hole 92. A first mounting screw 94 is passed through mounting hole 91 and into the motor mounting hole, while a second mounting screw 95 is passed through mounting hole 92 and into the motor mounting hole. The blade iron 90 may pivot about the first mounting screw 94 through movement of the second mounting screw 95 along arcuate mounting hole 92. The mounting of the blade to the blade iron may similarly occur through a similar hole arrangement.

It should be understood that the pivotal movement of the blade iron and/or the blade is laterally and generally along the plane of the blade rotation during use of the ceiling fan. Of course, as the blades are oriented at an angle or pitch the term lateral movement is intended to include any offset created by such pitch, i.e., the movement may be at a pitch angle from the exact plane of blade rotation. As such, the term is intended to denote a pivotal movement generally along a radii extending from an axis along the center of the motor (an axis about which the fan blades rotate) to an equilibrium position. The equilibrium position is determined by the weight and radial alignment of the blade and/or blade iron.

It should be understood that the current invention is not intended to be limited to ceiling fans and may apply equally to all types of fans.

It thus is seen that a ceiling fan is now provided which balances itself. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A fan comprising, an electric motor;

an annular array of blade irons, each said blade iron being operationally coupled to said motor for lateral pivotal movement between said motor and said blade iron during use; and a ceiling fan blade associated with each said blade iron of said annular array of blade irons, whereby a blade iron is configured to be pivotally moved relative to the motor towards an equilibrium position.

2. The fan of claim 1 wherein said blade iron includes two arcuate mounting holes and a blade iron mounting screw extending through each said mounting hole and coupled to said electric motor.

3. The fan of claim 1 wherein said blade iron includes a first mounting hole, a first blade iron mounting screw passing through said first mounting hole and coupled to said electric motor, a second, arcuate mounting hole, and a second blade iron mounting screw passing through said second, arcuate mounting hole and coupled to said electric motor.

4. The fan of claim 1 wherein each said blade is pivotally coupled to an associated blade iron.

5. The fan of claim 4 wherein each said blade includes at least one arcuate mounting hole and a blade mounting screw passing through said blade arcuate mounting hole and coupled to said blade iron.

6. A fan comprising, an electric motor;

an annular array of blade irons; and a ceiling fan blade associated with each said blade iron of said annular array of blade irons, each said blade being operationally coupled to said blade iron for lateral pivotal movement between said blade and said blade iron during use, whereby a blade is configured to be pivotally moved relative to the blade iron towards an equilibrium position.

7. The fan of claim 6 wherein each said blade includes at least one arcuate mounting hole and a blade mounting screw passing through said blade arcuate mounting hole and coupled to said blade iron.

8. The fan of claim 6 wherein each said blade iron is pivotally coupled to said electric motor.

9. The fan of claim 8 wherein said blade iron includes two arcuate mounting holes and a blade iron mounting screw extending through each said mounting hole and coupled to said electric motor.

10. The fan of claim 8 wherein said blade iron includes a first mounting hole, a first blade iron mounting screw passing through said first mounting hole and coupled to said electric motor, a second, arcuate mounting hole, and a second blade iron mounting screw passing through said second, arcuate mounting hole and coupled to said electric motor.

11. A fan comprising, an electric motor;

an annular array of blade irons;

a ceiling fan blade associated with each said blade iron of said annular array of blade irons, and blade iron pivot means for allowing operational pivotal movement between said motor and said blade irons during use, whereby a blade iron is configured to be pivotally moved relative to the motor towards an equilibrium position.

12. The fan of claim 11 wherein said blade iron pivot means comprises two arcuate mounting holes extending through each said blade iron and a blade iron mounting screw extending through each said mounting hole and coupled to said electric motor.

13. The fan of claim 11 wherein said blade iron pivot means comprises a first mounting hole extending through each said blade iron, a first blade iron mounting screw passing through said first mounting hole and coupled to said electric motor, a second, arcuate mounting hole extending through each said blade iron, and a second blade iron mounting screw passing through said second, arcuate mounting hole and coupled to said electric motor.

14. The fan of claim 11 further comprising blade pivot means for allowing pivotal movement of said blades relative to said blade irons.

15. The fan of claim 14 wherein said blade pivot means comprises at least one arcuate mounting hole extending through each said blade and a blade mounting screw passing through said blade arcuate mounting hole and coupled to said blade iron.

16. A fan comprising, an electric motor;

an annular array of blade irons;

a ceiling fan blade associated with each said blade iron of said annular array of blade irons, and blade pivot means for allowing operational pivotal movement of said blades relative to said blade irons during use, whereby a blade is configured to be pivotal moved relative to the blade iron towards an equilibrium position.

17. The fan of claim 16 wherein said blade pivot means comprises at least one arcuate mounting hole extending through each said blade and a blade mounting screw passing through said blade arcuate mounting hole and coupled to said blade iron.

18. The fan of claim 16 further comprising blade iron pivot means for allowing pivotal movement of said blade irons relative to said electric motor.

19. The fan of claim 18 wherein said blade iron pivot means includes two arcuate mounting holes extending through each said blade iron and a blade iron mounting screw extending through each said mounting hole and coupled to said electric motor.

20. The fan of claim 18 wherein said blade iron pivot means comprises a first mounting hole extending through each said blade iron, a first blade iron mounting screw passing through said first mounting hole and coupled to said electric motor, a second, arcuate mounting hole extending through each said blade iron, and a second blade iron mounting screw passing through said second, arcuate mounting hole and coupled to said electric motor.

* * * * *